US005129510A

United States Patent [19]

Wright

[11] Patent Number: 5,129,510

[45] Date of Patent: Jul. 14, 1992

[54] NECKLACE STORAGE APPARATUS

[76] Inventor: Alan H. Wright, 5002 East Rd. IS, Monte Vista, Colo. 81144

[21] Appl. No.: 753,122

[22] Filed: Aug. 30, 1991

[51] Int. Cl.[5] ..... A45C 11/04

[52] U.S. Cl. ..... 206/6.1; 206/566; 206/49

[58] Field of Search ..... 206/6.1, 49, 388, 560, 206/561, 566; 211/60.1, 175

[56] References Cited

U.S. PATENT DOCUMENTS

| | | | |
|---|---|---|---|
| 549,970 | 11/1895 | Lawrence | 206/566 |
| 579,523 | 3/1897 | Turner | 206/388 |
| 1,436,233 | 11/1922 | Brown | 206/566 |
| 2,410,161 | 10/1946 | Helbein . | |
| 2,412,450 | 12/1946 | Fink . | |
| 3,243,049 | 3/1966 | Seligmann et al. | 206/560 |
| 3,640,399 | 2/1972 | Hartman | 211/175 |
| 3,648,831 | 3/1972 | Arnone | 206/566 |
| 3,687,280 | 8/1972 | Fortannaz | 206/560 |
| 4,216,858 | 8/1980 | Beauchamp . | |
| 4,324,446 | 4/1982 | Lesage . | |

FOREIGN PATENT DOCUMENTS

| | | | |
|---|---|---|---|
| 247002 | 2/1926 | United Kingdom | 206/566 |

*Primary Examiner*—David T. Fidel
*Attorney, Agent, or Firm*—Henderson & Sturm

[57] ABSTRACT

A necklace support apparatus (10) for supporting a necklace (50) in a mildly tensioned state; wherein, the apparatus (10) comprises a housing member (20) having first (30) and second (40) support members; wherein, at least one of the support members (40) is moveable relative to the other support member (30); so that the necklace can be looped over and be captively engaged between the two support members (30) and (40).

3 Claims, 1 Drawing Sheet

FIG. 1.
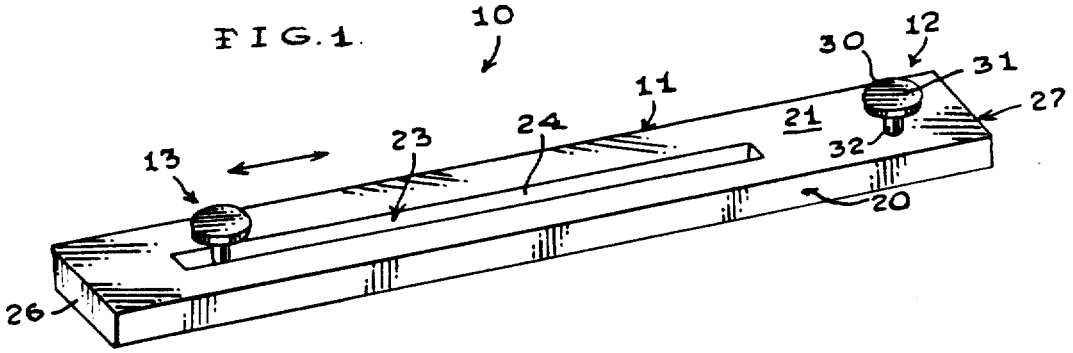
FIG. 2.
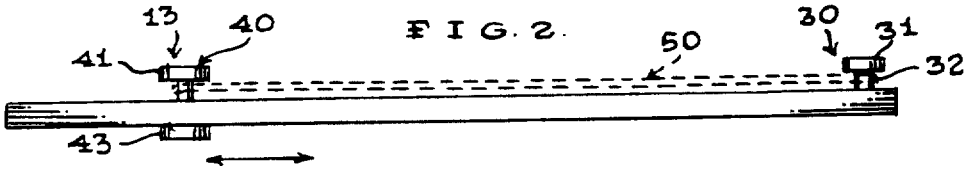
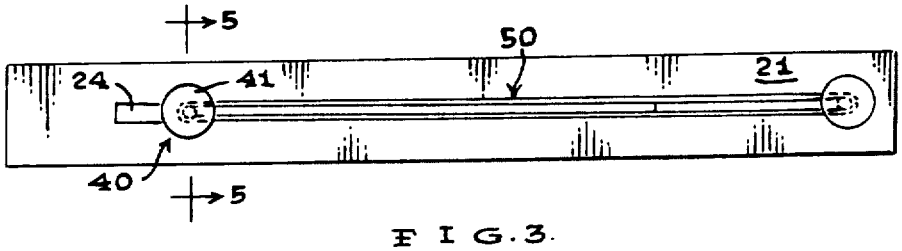
FIG. 3.
FIG. 4.
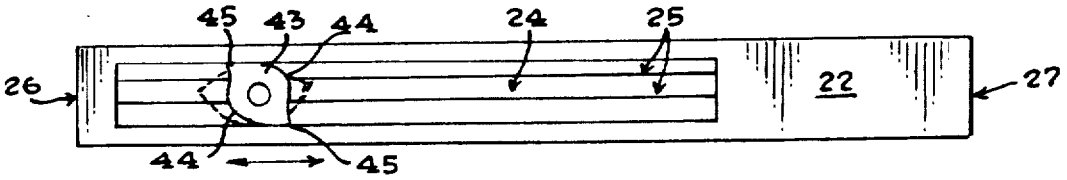
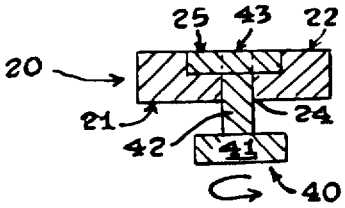
FIG. 5.

NECKLACE STORAGE APPARATUS

TECHNICAL FIELD

The present invention relates to the support devices for jewelry in general, and in particular to an apparatus that will store necklaces such that they cannot become entangled with one another.

BACKGROUND ART

This invention was the subject matter of Document Disclosure Program Registration No. 277,997 which was filed in the United States Patent and Trademark Office on Apr. 3, 1991.

As can be seen by reference to the following U.S. Pat. Nos. 2,410,161; 2,412,450; 4,216,858; and 4,324,446; the prior art is replete with myriad and diverse jewelry storage and display arrangements.

While all of the aforementioned prior art constructions are more than adequate for the basic purpose and function for which they have been specifically designed, these devices with the possible exception of U.S. Pat. No. 4,324,446 have done little or nothing to address the problem of keeping necklaces from becoming intertwined with one another during storage. Even the '446 patent will permit this situation to arise since under certain circumstances the loose lower ends of the individual necklaces can become entangled with one another even though the upper ends of the necklaces remain segregated from one another.

As a consequence of the foregoing situation, there has existed a longstanding need among owners of necklaces for a safe and secure manner of storing their necklaces such that the necklaces cannot become entangled with one another since the necklaces are maintained in a mildly tensioned disposition; and, the provision of such a construction is a stated objective of the present invention.

DISCLOSURE OF THE INVENTION

Briefly stated, the necklace storage apparatus that forms the basis of the present invention comprises a base unit and a pair of post units which are moveable relative to one another; and operatively associated with the base unit.

In addition one of the post units is mounted in stationary fashion relative to the base unit while the other post unit is mounted in a moveable relationship relative to both the first post unit and the base unit; and is further provided with a releasable cam member which will releasably engage the second post unit at a desired location relative to the base unit.

As will be explained in greater detail further on in the specification, the necklace storage apparatus that forms the basis of this invention allows the user to place individual necklaces into a mildly tensioned captive disposition such that the individual necklaces cannot be removed from the storage apparatus unit the releasable cam member has been released from engagement with the base unit; and, the second post unit is translated towards the first post unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an isolated perspective view of the necklace support apparatus;

FIG. 2 is a side plan view of the apparatus operatively engaged with a necklace;

FIG. 3. is a top plan view of the apparatus engaged with a necklace;

FIG. 4 is a bottom plan view of the apparatus; and,

FIG. 5 is a cross-sectional view taken through line 5—5 of FIG. 3.

BEST MODE FOR CARRYING OUT THE INVENTION

As can be seen by reference to the drawings, and in particular to FIG. 1, the necklace support apparatus that forms the basis of the present invention is designated generally by the reference numeral (10). The support apparatus (10) comprises in general a base unit (11) and a pair of support units (12) and (13). These units will now be described in seriatim fashion.

As can best be seen by reference to FIGS. 1 and 3 through 5 the base unit (11) comprises a generally flat and thick elongated rectangular housing member (20) having a top surface (21) and a bottom surface (22); wherein, the housing member is further provided with an elongated stepped shoulder aperture (23); wherein the upper portion of the aperture (23) defines a relatively narrow elongated slot (24); and, the lower portion of the aperture (23) defines a relatively wide elongated slot (25).

As shown in FIGS. 1, 4 and 5, the elongated aperture (23) extends from proximate one end (26) of the housing member (20) to a point proximate to, but spaced from, the other end (27) of the housing member (20). In addition, as shown in FIG. 5, the elongated stepped shoulder aperture (23) defines an inverted generally T-shaped aperture which extends from the top surface (21) to the bottom surface (22) of the housing member (20).

Turning now to FIGS. 1 through 3 it can be seen that the first support unit (12) comprises a first fixed support member (30) having an enlarged head (31) attached to a relatively short support post stem (32); wherein, the support post stem (32) is fixedly secured on the top surface (21) of the housing member (20) intermediate the elongated aperture (23) and the right hand end (27) of the housing member (20).

As can best be appreciated by reference to FIGS. 2 through 5, the second support unit (13) comprises a second moveable support member (40) having an enlarged head (41) formed on the upper end of a relatively elongated support post shaft (42) whose lower end is further provided with a contoured cam element (43).

As shown in FIG. 4, the contoured cam element (43) is provided with an arcuate intermediate portion (44) and a pair of oppositely facing outwardly projecting cam teeth (45); wherein, in the solid line orientation the cam teeth (45) are adapted to releasably engage the sides of the housing member (20) which define the relatively wide elongated slot (25) formed in the bottom surface (22) of the housing member (20); and, wherein the arcuate sides (44) of the cam element (43) in the dashed line orientation are dimensioned to allow the cam element (43) to slide freely along the entire length of the relatively wide elongated slot (25).

At this juncture it should also be mentioned that in the preferred embodiment of the invention depicted in the drawings, the cam element (43) is intended to be fabricated from a resiliently deformable material such as rubber or the like, so as to enhance the frictional engagement of the cam teeth (45) with the interior walls of the enlarged recess (25).

It should further be noted at this juncture that the support apparatus (10) is not to be limited to captively engaging a single necklace (50); but, can also be expanded to accommodate a number of necklaces (50) by widening the housing member (20) and equipping it with a plurality of parallel stepped apertures (23) wherein each stepped aperture (23) is provided with the associated first (12) and second (13) support units.

It should also be obvious that the operation of the apparatus (10) requires that one end of a necklace is looped over the first fixed support unit (12) and then the other end of the necklace is looped over the second moveable support unit (13); wherein, the second moveable support unit (13) is moved away from the first fixed support unit (12) to place the necklace (50) into a mild state of tension; wherein, the second moveable support unit (13) is then rotated to releasably engage the cam teeth (45) in the enlarged recess (25).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A necklace storage apparatus for supporting a necklace in a dual location captive orientation wherein the apparatus comprises:

a base unit including a housing member having a top surface a bottom surface and an elongated aperture a first support unit fixedly secured to the top surface of the housing member and dimensioned to releasably receive one end of said necklace; and, a second support unit movably and operably associated with said housing member for varying the spacing of said second support unit relative to said first support unit; wherein, said second support unit comprises a second support member having an enlarged head formed on one end of a support shaft wherein the other end of said support shaft is provided with an unevenly contoured arcuate cam element for frictionally engaging and releasing said second support unit in the aperture in the housing member at a selected location relative to said first support unit.

2. The apparatus as in claim 1; wherein, said arcuate cam element is provided with at least one outwardly projecting cam tooth dimensioned to frictionally engage one side of said aperture.

3. The apparatus as in claim 2; wherein said cam element is fabricated from a resilient material.

* * * * *